United States Patent [19]

Okada et al.

[11] 4,201,173

[45] May 6, 1980

[54] IGNITION APPARATUS FOR MULTI-CYLINDER RECIPROCATING INTERNAL COMBUSTION ENGINE

[75] Inventors: Tomoyuki Okada, Tsuchiura; Noboru Sugiura, Katsuta, both of Japan

[73] Assignee: Hitachi, Ltd., Japan

[21] Appl. No.: 898,683

[22] Filed: Apr. 21, 1978

[30] Foreign Application Priority Data

Apr. 22, 1977 [JP] Japan ..... 52/45783
Jun. 8, 1977 [JP] Japan ..... 52/66637

[51] Int. Cl.[2] ..... F02P 15/02

[52] U.S. Cl. ..... 123/148 C; 123/148 DS; 123/148 E

[58] Field of Search ..... 123/118, 148 C, 148 DS, 123/148 S, 148 E

[56] References Cited

U.S. PATENT DOCUMENTS

| | | | |
|---|---|---|---|
| 3,738,340 | 6/1973 | Olson | 123/118 |
| 3,762,383 | 10/1973 | Richards et al. | 123/148 E |
| 3,809,042 | 5/1974 | Hosho et al. | 123/148 C |
| 3,828,752 | 8/1974 | Hioki et al. | 123/148 DS |
| 3,935,844 | 2/1976 | Nishimiya et al. | 123/117 R |
| 3,964,454 | 6/1976 | Nishimiya | 123/148 DS |

FOREIGN PATENT DOCUMENTS

| | | | |
|---|---|---|---|
| 2529172 | 2/1977 | Fed. Rep. of Germany | 123/148 E |

*Primary Examiner*—Ronald H. Lazarus
*Assistant Examiner*—Andrew M. Dolinar
*Attorney, Agent, or Firm*—Craig & Antonelli

[57] ABSTRACT

An ignition apparatus for a multi-cylinder reciprocating internal combustion engine has a plurality of spark plugs arranged in each of the cylinders with each spark plug having a high voltage generating circuit. The ignition apparatus comprises an ignition signal generating circuit for generating a timing signal in accordance with the rotation of the engine, an actuation signal generating circuit responsive to the ignition signal to actuate the respective high voltage generating circuits to generate high voltages for causing the spark plugs connected to the respective high voltage generating circuits to generate sparks, and a disabling signal generating circuit for generating a disabling signal for disabling the sparking of a selected one of the plurality of spark plugs. The actuation signal generating circuit responds to an ignition signal to apply actuation signals to the corresponding high voltage generating circuits to actuate them to generate high voltages for effecting the sparking of the spark plugs. If a disabling signal is generated, at the time when the one of the high voltage generating circuits corresponding to the selected ignition plug is already supplied with an actuation signal, the actuation thereof is continued until it finishes the ignition and thereafter the application of an actuation signal to the selected high voltage generating circuit is inhibited as long as the disabling signal continues. If a disabling signal is generated at the time when the selected high voltage generating circuit is not actuated, the application of an actuation signal to the selected high voltage generating circuit is inhibited as long as the disabling signal continues.

11 Claims, 8 Drawing Figures

IGNITION APPARATUS FOR MULTI-CYLINDER RECIPROCATING INTERNAL COMBUSTION ENGINE

LIST OF PRIOR ART REFERENCES (35 CFR 1.56 (a))

The following references are cited to show the state of art:

(1) U.S. Pat. No. 3,809,042
(2) U.S. Pat. No. 3,935,844
(3) U.S. Pat. No. 3,964,454

BACKGROUND OF THE INVENTION

The present invention relates to an ignition apparatus for a multi-cylinder reciprocating internal combustion engine, and more particularly to an ignition apparatus for a multi-cylinder reciprocating internal combustion engine having a plurality of spark plugs for each cylinder, in which the sparking of at least a selected one of said plurality of spark plugs may be effectively disabled.

Heretofore, a conventional reciprocating internal combustion engine has had a single spark plug for each cylinder. In recent years, however, under a special condition in which, for example, the use of lean air-fuel mixture in a combustion chamber is required in order to suppress the amount of NOx in the exhaust gas below a predetermined amount, a plurality of, for example, two, spark plugs have been used for each cylinder in order to solve the problem of instability of combustion. Such technology is known as a 1-cylinder 2-plug system and shown in the U.S. Pat. No. 3,809,402, U.S. Pat. No. 3,935,844 and U.S. Pat. No. 3,964,454.

In the multi-cylinder reciprocating internal combustion engines, such as a 1-cylinder, 2-plug system internal combustion engine, having a plurality of spark plugs for each cylinder, it is desired to switch the operation mode such that one spark plug is operated for each cylinder under a normal condition while two plugs are operated for each cylinder under a special condition. In order to switch the operation mode a transistorized ignition apparatus may be used, for example, to control the operation of a power transistor which controls the primary current of an ignition coil by a switching signal. Namely, a power transistor for driving a selected one of the two spark plugs for each cylinder is disabled under normal conditions but enabled only under the special conditions, while another power transistor for driving the other spark plug is always enabled. In this case, when the power transistor for driving the selected one spark plug is switched from the disabled state to the enabled state, no problem occurs but a problem occurs in the opposite case. That is, when the operation of a power transistor which controls the primary current of an ignition coil is stopped at any time point, a high voltage may be unexpectedly generated in the secondary of the ignition coil so that a spark may occur at the associated spark plug at an undesired time point other than a normal ignition timing. As a result, the operability is deteriorated and the durability of the engine is lowered.

SUMMARY OF THE INVENTION

It is an object of the present invention to provide an ignition apparatus which has overcome the above inconveniences.

According to a feature of the present invention, if an ignition disabling command for a selected spark plug is issued at the time when the selected spark plug is not in the process of sparking operation, the application of an ignition command to the selected spark plug is inhibited immediately after the instant for as long as the ignition disabling command continues. On the contrary, if an ignition disabling command is issued at the time when the selected spark plug is in the process of sparking, the sparking operation is allowed to continue until it is completed, and the application of the ignition command is inhibited after the completion of the sparking for as long as the ignition disabling command continues.

BRIEF DESCRIPTION OF THE DRAWINGS

The present invention will be described in detail with reference to the accompanying drawings wherein.

DETAILED DESCRIPTION OF THE PREFERRED EMBODIMENTS

Figure 1:
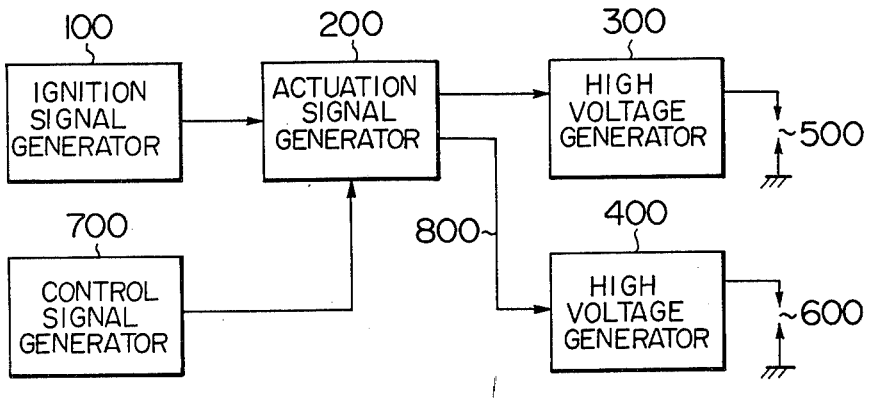
FIG. 1 shows a block diagram for explaining the basic concept of the present invention.

FIG. 1 shows a block diagram for explaining the basic configuration of an ignition apparatus of the present invention. For the convenience of explanation, the ignition apparatus is shown for only one cylinder for a 1-cylinder 2-plug system. The ignition apparatus comprises an ignition signal generating circuit 100 for generating an ignition signal indicative of ignition timing in accordance with the rotation of an engine (not shown), high voltage generating circuits 300 and 400 for applying high voltages to spark plugs 500 and 600, respectively, to produce sparks at the spark plugs 500 and 600, an actuation signal generating circuit 200 responsive to the ignition signal to generate actuation signals to actuate the respective high voltage generators 300 and 400 to cause them to generate high voltages and a control signal generating circuit 700 for applying a control signal to the actuation signal generating circuit 200 to control the generation of the actuation signal for the high voltage generating circuit 400, thereby controlling the operation of the spark plug 600. Under normal conditions, the actuation signal generating circuit 200 is controlled by the control signal from the control signal generating circuit 700 such that only the actuation signal to the high voltage generating circuit 300 is applied to actuate the spark plug 500 and no actuation signal to the high voltage generating circuit 400 for the spark plug 600 is applied, but under special conditions the actuation signal generating circuit 200 is controlled by the control signal generating circuit 700 such that the actuation signal is applied also to the high voltage generating circuit 400 to actuate the spark plug 600 in addition to the actuation of the high voltage generating circuit 300. As described above, in the prior art system, no problem occurs when the actuation of the spark plug 600 is started at any time by the control signal from the control signal generating circuit 700, but a problem may occur when the actuation of the spark plug 600 is stopped. It is, therefore, the object of the present invention to resolve the above problem. Accordingly, such a case where the actuation of the spark plug 600 is stopped during the operation thereof by the control signal from the control signal generating circuit 700 is considered herein. For the convenience of explanation, it is assumed that the actuation of the normally operating spark plug 600 is stopped by the control signal from the control signal generator 700 which commands the stop of the sparking operation of the spark plug 600, and the control signal which commands the stop of the sparking operation is hereinafter simply referred to as an ignition disabling signal and the control signal generating circuit is hereinafter referred to as a disabling signal generating circuit.

According to the present invention, the actuation signal generating circuit 200 responds to an ignition signal generated by the ignition signal generating circuit 100 in accordance with the rotation of the engine to apply the respective actuation signals to the high voltage generating circuits 300 and 400. Those actuation signals may be in phase or out of phase, as required. When an ignition disabling signal for the spark plug 600 is generated from the disabling signal generating circuit 700, the actuation signal generating circuit 200 continues to apply the actuation signal to the high voltage generating circuit 300 irrespective of the issuance of the ignition disabling signal but stops applying the actuation signal to the high voltage generating circuit 400. In this case, however, if the actuation signal is being applied to the high voltage generating circuit 400 and the high voltage generating circuit 400 is generating the high voltage, the application of the actuation signal to the high voltage generating circuit 400 is not stopped at the time of the application of the ignition disabling signal but continued until the sparking operation by the high voltage generating circuit 400 for the spark plug 600 finishes and thereafter the application of the actuation signal to the high voltage generating circuit 400 is inhibited so long as the ignition disabling signal continues to be applied to the actuation signal generating circuit 200, so that the sparking at the spark plug 600 is inhibited. If no actuation signal is being applied to the high voltage generating circuit 400 when the ignition disabling signal is applied to the actuation signal generating circuit 200, immediately after this instant the subsequent application of the actuation signal to the high voltage generating circuit 400 is inhibited. The above operations are controlled by the actuation signal generating circuit 200.

Figure 2:
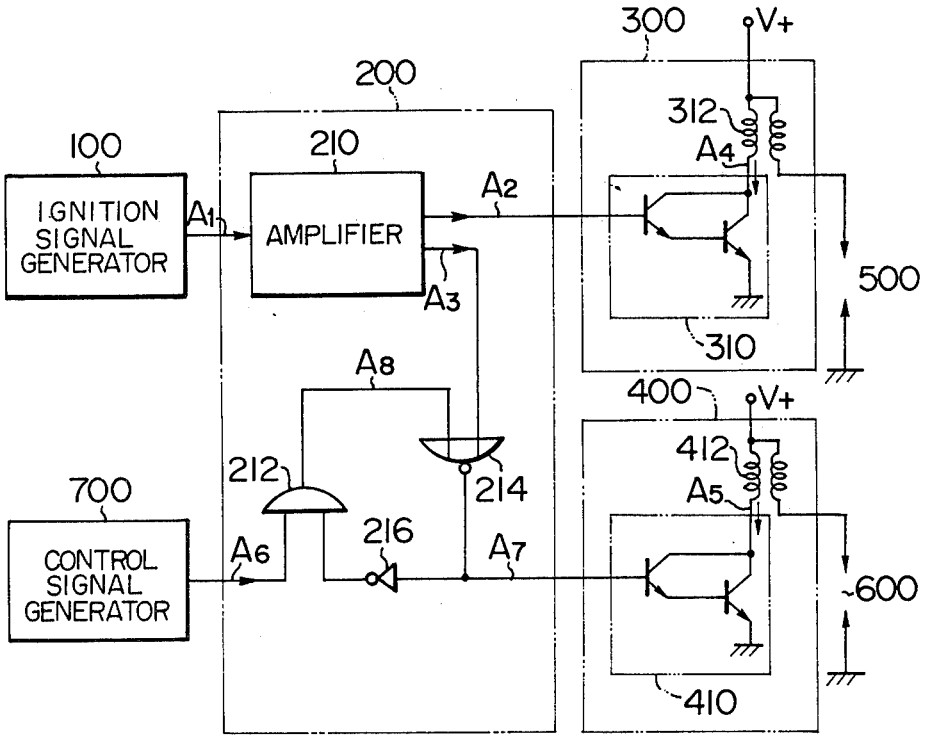
FIG. 2 shows a schematic circuit diagram of one embodiment of the present invention.
Figure 3:
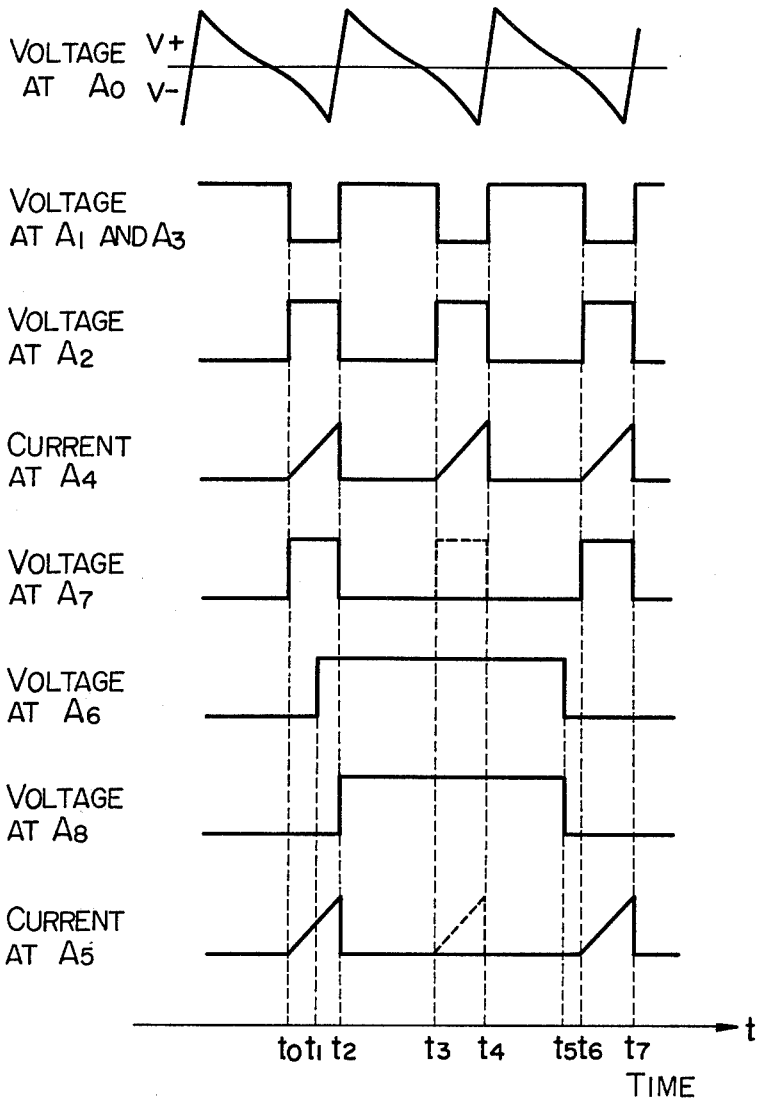
FIG. 3 shows waveforms at various points in FIG. 2.

FIG. 2 shows a circuit diagram of a preferred embodiment of the present invention which shows the details of the block diagram of FIG. 1, and FIG. 3 shows voltage waveforms and current waveforms at various points in FIG. 2. In FIG. 2 and subsequent drawings, the like reference numerals to those used in the preceeding drawings show the components having similar or the same functions.

Referring to FIG. 2, the actuation signal generating circuit 200 comprises an amplifier 210, an AND gate 212, a NOR gate 214, and an inverter 216, the high voltage generating circuit 300 comprises a power transistor circuit 310 which may be a Darlington transistor circuit and an ignition coil 312, and the high voltage generating circuit 400 comprises a power transistor circuit 410 which may be another Darlington transistor circuit and an ignition coil 412.

The ignition signal generating circuit 100 comprises a pickup coil (not shown) which generates an A.C. signal indicative of the ignition timings at an output terminal $A_0$ (not shown) in accordance with the rotation of the engine, and a waveform shaper (not shown) which shapes the signal at the output terminal $A_0$ to produce an ignition signal at a point $A_1$. The ignition signal at the point $A_1$ is applied to the amplifier 210 of the actuation signal generating circuit 200 where it is amplified to produce signals at points $A_2$ and $A_3$, as shown in FIG. 3. While the signals $A_1$ and $A_3$ are shown as being the same waveform in FIG. 3, they are drawn in one waveform because they are in phase and it should be understood that the signals $A_3$ and $A_1$ are separate from each other and the levels thereof are not necessarily same. The signal $A_2$ is the amplified version of the signal $A_1$ and has the same level as the signal $A_3$ but they are opposite in phase.

When the voltage level of each of the signals $A_2$ and $A_7$ is high or logical "1", it renders the respective power or Darlington transistor circuit 310 and 410 conductive to flow currents having waveforms as shown in FIG. 3 through the respective points $A_4$ and $A_5$ of the primary sides of the ignition coils 312 and 412, respectively, so that when the current waveforms become low level or logical "0" the power transistor circuits 310 and 410 are turned off to cut off the current $A_4$ or $A_5$ in the primary sides of the ignition coils 312 and 412, respectively, to generate high voltages at secondary sides thereof, which high voltages cause sparks to occur at the corresponding spark plug 600 and 700 respectively. The signal $A_7$ is produced at the point $A_7$ as the output of the NOR gate 214 to which the signal $A_3$ is applied. Because of the passage through the NOR gate 214 the signal $A_7$ is opposite in phase to the signal $A_3$ and in phase to the signal $A_2$. (Although the signal $A_7$ may be out of phase to the signal $A_2$ as described above, they are assumed to be in phase with each other in the following description.) Thus, the signals $A_2$ and $A_7$ are applied to the high voltage generating circuits 300 and 400, respectively, corresponding to the spark plugs 500 and 600, as the actuation signals thereto. Hereinafter, when it is stated simply that "the actuation signal is applied", it means that the high level or logical "1" signal $A_2$ or $A_7$ is applied, and when it is stated that "the actuation signal is not applied", it means that the low level or logical "0" signal $A_2$ or $A_7$ is applied. The same convention is applicable to the other signals.

The disabling signal generating circuit 700 produces an ignition disabling signal at the point $A_6$, which is a binary signal having a high level or logical "1" and a low level or logical "0", as shown in FIG. 3. When it is low or "0" level, it allows the sparking operation of the spark plug 600, and when it is high or "1" level, it commands to stop the sparking operation of the spark plug 600.

The operation is now explained. When the output $A_6$ of the disabling signal generating circuit 700 is at low level, that is, when the ignition disabling command is not issued, the output $A_8$ of the AND gate 212 is at low level whether the output of the inverter 216 is at low level or at high level. Thus, the output $A_7$ of the NOR gate 214 is at high level when the signal $A_3$ is at low level and it is at low level when the signal $A_3$ is at high level. Thus, the NOR gate 214 produces an output signal at the point $A_7$ which is opposite in phase to the signal $A_3$ as shown in FIG. 3, and therefore is in phase with the signal $A_2$. In the manner, the high voltage generating circuit 400 receives the actuation signal which is in phase with and of the same level as that of the high voltage generating circuit 300, and it carries out the ignition operation in the same manner as the high voltage generating circuit 300.

Now, consider a case where the output of the disabling signal generating circuit 700 is changed to a high level by the external disabling command. When the output signal $A_6$ of the disabling signal generating circuit 700 changes from a low level to a high level, the signal $A_2$ is not influenced thereby. That is, the sparking operation of the spark plug 500 is effected independently of the level of the ignition disabling signal. On the other hand, the sparking operation of the spark plug 600 is controlled by the ignition disabling signal $A_6$. That is, if the signal $A_6$ changes from a low level to a high level at the time when the signal $A_3$ is at its high level, the output $A_7$ of the NOR gate 214 assumes its low level and hence the output of the inverter 216 assumes its high level and the output $A_8$ of the AND gate 212 assumes its high level. As a result, the output of the NOR gate 214, that is, the input signal $A_7$ to the power transistor circuit 410 of the high voltage generating circuit 400 is maintained at its low level so that the ignition coil 412 is not energized and hence the spark plug 600 is not sparked, so long as the disabling signal $A_6$ maintains its high level, even if the next ignition signal is issued to thereby render the signal $A_3$ low.

On the other hand, let consider a case where when the ignition disabling signal is produced at the time $t_1$ as shown in FIG. 3, that is, when the ignition disabling signal $A_6$ changes from low level to high level at the time $t_1$, the ignition operation is being effected by the high voltage generating circuit 400, that is, the actuation signal $A_7$ has turned to its high level at the time $t_0$ prior to the time $t_1$ to turn on the power transistor circuit 410 so that the current $A_5$ having such a waveform is shown in FIG. 3 is flowing through the primary of the ignition coil 412. In this case, immediately before the time $t_1$ at which the ignition disabling signal $A_6$ changes from its low level to its high level, the output signal $A_8$ of the AND gate 212 was at its low level and the output signal $A_3$ of the amplifier 210 was also at its low level so that the output signal $A_7$ of the NOR gate 214 was at its high level. Under this condition in which the output signal $A_3$ of the amplifier 210 has been at its low level and the output signal $A_7$ of the NOR gate 214 has been at its high level, if the ignition disabling signal $A_6$ changes from its low level to its high level at the time $t_1$, the output signal $A_8$ of the AND gate 212 remains at the low level because the output signal of the inverter 216 is at its low level. As a result, the output signal of the NOR gate 214, that is, the actuation signal $A_7$ to the power transistor circuit 410 remains at its high level so that the high voltage generating circuit 400 is allowed to continue its ignition operation. This ignition operation is terminated when the actuation signal $A_7$ changes from its high level to its low level at the time $t_2$, and then the power transistor circuit 410 is turned off to block the current through the ignition coil 412 resulting in the generation of a high voltage at the secondary of the ignition coil 412 to produce a spark at the spark plug 600. The level of the actuation signal $A_7$ is changed to its low level in the following manner. When the signal $A_3$ which has been thus far at its low level is changed to its high level at the time $t_2$, since one of the two inputs to the NOR gate 214 changes to its high level the output signal $A_7$ of the NOR gate 214 changes to its low level to turn off the power transistor circuit 410. Thus, in the preferred embodiment, when the high voltage generating circuit 400 is effecting the ignition operation, that is, when the signal $A_3$ is at its low level and hence the actuation signal $A_7$ is at its high level, even if the disabling command is issued, for example at the time $t_1$, to change the signal $A_6$ to its high level, the sparking operation of the spark plug 600 is not interrupted but it is allowed to continue until it terminates at the time $t_2$. When the signal $A_7$ changes from its high level to its low level at the time $t_2$, the output signal of the inverter 216 changes from its low level to its high level. Since the ignition disabling signal $A_6$ has been changed from its low level to its high level at this time, the output signal $A_8$ of the AND gate 212 changes from its low level to its high level. However, since the signal $A_3$ has been changed from its low level to its high level at this time and hence the output signal $A_7$ of the NOR gate 214 has been at its low level, the level of the output signal $A_7$ of the NOR gate 214 does not change and remains at its low level although the signal $A_8$ applied to the other input of the NOR gate 214 changes from its low level to its high level. Under this condition, if the input signal $A_3$ to the NOR gate 214 changes from its high level to its low level at the time $t_3$ so that the amplifier 210 indicates the arrival of the next ignition timing, the output signal $A_7$ of the NOR gate 214 remains at its low level because the signal $A_8$ applied to the other input of the NOR gate 214 is at its high level. Accordingly, the sparking operation of the spark plug 600 is inhibited. Thus, even if the low level signal $A_3$ commanding the ignition is applied to the NOR gate 214 after the time $t_2$, the actuation signal is not applied to the high voltage generating circuit 400 thereby inhibiting the sparking of the spark plug 600 so long as the ignition disabling command is present, that is, so long as the ignition disabling signal $A_6$ remains at its high level. The waveforms shown by broken lines in the voltage waveform $A_7$ and the current waveform $A_5$ in FIG. 3 show the waveform portions which would occur if the disabling command is not present, that is, if the voltage signal $A_6$ remains at its low level. If the voltage waveform $A_7$ should change at the time $t_3$ to its high level as shown by the broken line, the current waveform $A_3$ would gradually increase from the time $t_3$ to ignite the spark plug 600 at the time $t_4$.

In this manner, if the ignition disabling signal which has been applied to the actuation signal generating circuit 200 is released at the time $t_5$, that is, if the signal $A_6$ changes from its high level to its low level, the signal $A_8$ is changed to its low level. Thereafter, accordingly, if the signal $A_7$ which is the phase-inverted version of the signal $A_3$ will be applied to the power transistor circuit 410 as the actuation signal thereto, the sparking operation of the spark plug 600 will be started again. Although, in the timing chart of FIG. 3, the signal $A_3$ is at its high level at the time $t_5$ so that the sparking of the spark plug 600 is not commanded, if the signal $A_3$ had been at its low level at the time $t_5$, the output $A_7$ of the NOR gate 214 would immediately assume its high level at that time $t_5$ to actuate the high voltage generating circuit 400 to generate a high voltage thereby producing a spark at the spark plug 600 upon the next change of the signal $A_3$ to its high level. No problem occurs, however, in this case, even if the magnitude of the current $A_5$ is not sufficiently large enough to cause a spark of sufficient energy for ignition.

Figure 4:
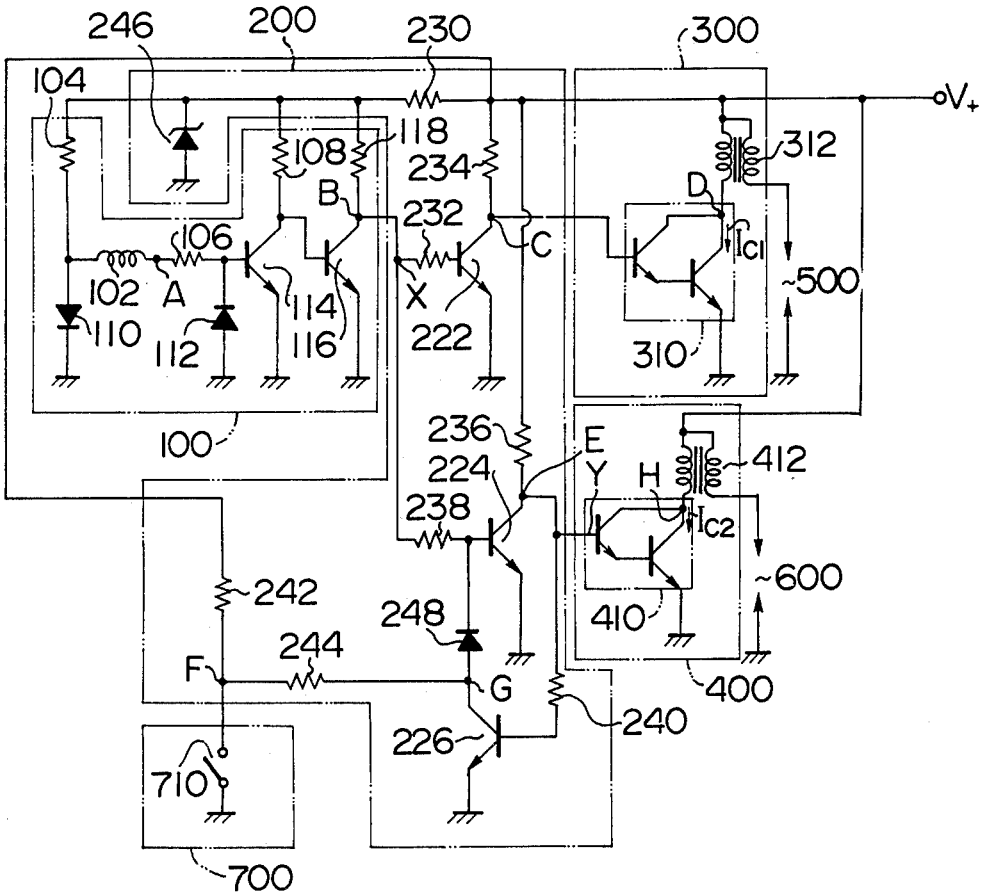
FIG. 4 shows a circuit diagram of another embodiment of the present invention.
Figure 5:
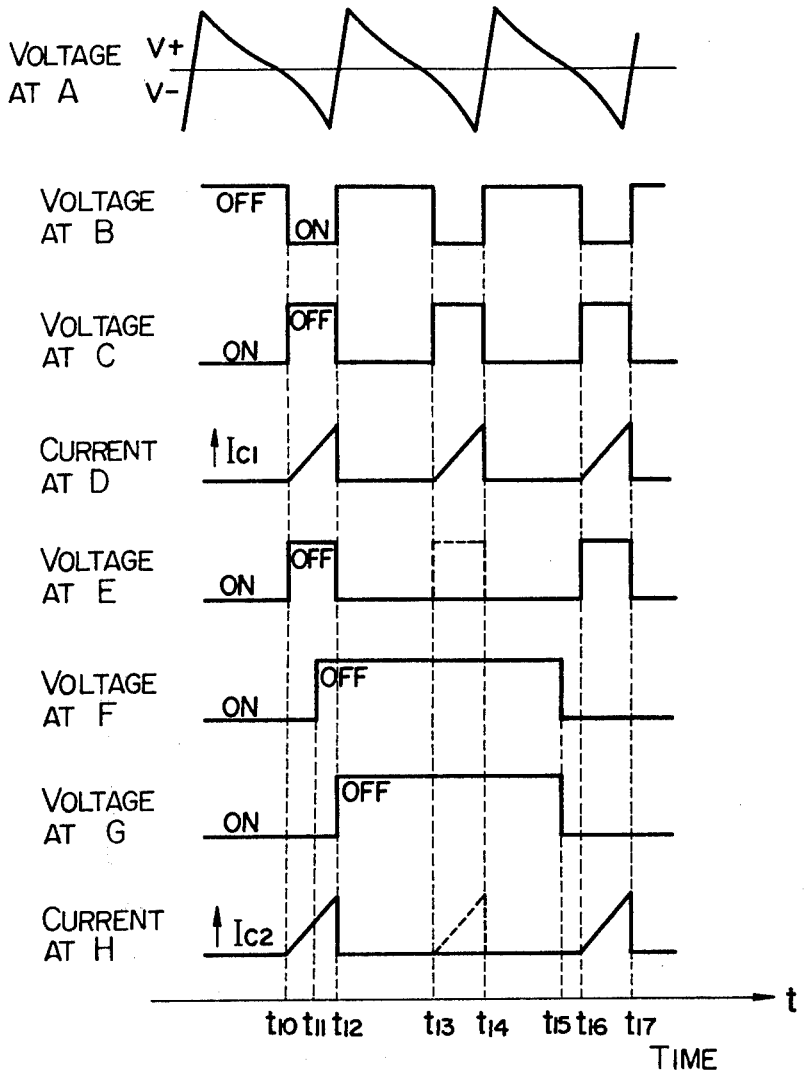
FIG. 5 shows waveforms at various points in FIG. 4.

FIG. 4 shows a specific circuit diagram of another preferred embodiment of the present invention, and FIG. 5 shows voltage and current waveforms at various points thereof. In FIG. 4, the designations of points A, B, C, . . . H are used instead of $A_0$, $A_1$, . . . $A_8$ used in FIG. 2. Although they do not necessarily correspond to each other, no specific explanation will be necessary to show particular correspondence therebetween.

The ignition signal generating circuit 100 comprises a pickup (PU) coil 102, resistors 104, 106, 108 and 118, diodes 110 and 112 and transistors 114 and 116, and the actuation signal generating circuit 200 comprises transistors 222, 224 and 226, resistors 230, 232, 234, 236, 238, 240, 242 and 244, a zener diode 246 and a diode 248. The transistors 224 and 226 constitute a flip-flop. The ignition disabling signal generating circuit 700 comprises a contact 710. "$V_+$" denotes a power supply fed to all the circuits.

FIG. 5 shows the voltage and current waveforms at the points A, B, C, D, E, F, G and H in the embodiment of FIG. 4. A positive-negative A.C. signal is generated at the point A, and a binary signal having logical "1" and logical "0" level as shown in FIG. 5 is produced at the collector terminal B of the transistor 116 in accordance with the on-off state thereof. The rise of the binary signal at the point B indicates the timing of proper ignition. The signal B is applied to each of the bases of the transistors 222 and 224 as an ignition signal. In the operating condition of the engine, the voltage level at the collector C of the transistor 222 changes in opposite phase to that of the transistor 116, as shown by the waveform C in FIG. 5, so that the power transistor circuit 310 supplies a primary current $I_{c1}$ as shown by the waveform D in FIG. 5 through the ignition coil 312. As a result, the spark plug 500 produces a spark. In this manner, the transistor 222 and the power transistor 310 are periodically turned on and off in accordance with the ignition signal B, and the operation of the ignition coil 312 is not interrupted during the operating condition of the engine.

On the other hand, a primary current $I_{c2}$ in the ignition coil 412 is controlled by the on-off state of the contact 710. The manner of control is explained below.

Assume that the energization period of the ignition coil 412 is from the time $t_{10}$ to the time $t_{12}$ as shown in FIG. 5. During this period, the ignition signal B is at its low level, that is, the transistor 116 is conductive, the transistor 224 is non-conductive and the transistor 226 is conductive. Under this condition, if the disabling command contact 710 is changed from its on-state to its off-state at the time $t_{11}$, the transistor 226 conducts more heavily but the transistor 224 remains non-conductive. Thus, during the energization period of the ignition coil, even if the contact 710 is changed from its on-state to its off-state, the energization of the ignition coil 412 remains the same as it was when the contact was in the on-state. Assume that the contact 710 maintains the off-state. During the off-state of the contact 710, when the ignition signal B changes to its high level at the time $t_{12}$, the transistor 116 changes from its on-state to its off-state and the transistor 224 changes from its off-state to its on-state so that the level at the point E changes from its high level to its low level as shown in FIG. 5. As a result, the power transistor circuit 410 changes from its on-state to its off-state to block the current $I_{c2}$ in the ignition coil 412 so that the sparking operation of the spark plug 600 terminates at the time $t_{12}$. When the transistor 224 once changes from its off-state to its on-state in this manner, the base of the transistor 226 assumes its low level and the transistor 226 changes from its on-state to its off-state. Under this condition, even if the transistor 220 is changed from its off-state to its on-state at the time $t_{13}$, the base voltage of the transistor 224 is at its high level through the power supply $V_+$, the point F, the point G and the diode 248, because the contact 710 is at its off-state. Therefore, the transistor 224 is maintained at its on-state irrespective of the on-off state of the transistor 116. It is thus apparent that after the completion of the sparking operation of the ignition coil 412 which has been operating at the time $t_{11}$ at which the contact 710 was changed from its on-state to its off-state, the ignition coil 412 is not energized so long as the contact 710 is at its off-state, even if the transistor 116 is subsequently turned on to change the ignition signal B to its high level. The waveform shown by broken lines in the voltage waveform E and the current waveform H in FIG. 5 show the waveform which would appear if the contact 710 were at its on-state.

As described above, in the embodiment of FIG. 4, when the disabling command contact 710 is changed from its on-state to its off-state to command to stop the sparking operation of the spark plug 600, if the ignition signal B is present at that time and the energization of the ignition coil 412 has started, the sparking operation is allowed to continue until the ignition by the spark plug 600 is completed, and thereafter the application of the actuation signal to the power transistor circuit 410 is inhibited to inhibit the operation of the spark plug 600 so long as the contact 710 is maintained at its off-state, even if the ignition signal B is thereafter generated by the ignition signal generating circuit 100. Thus, the embodiment of FIG. 4 operates in the same manner as the circuits of FIGS. 1 and 2.

Figure 6:
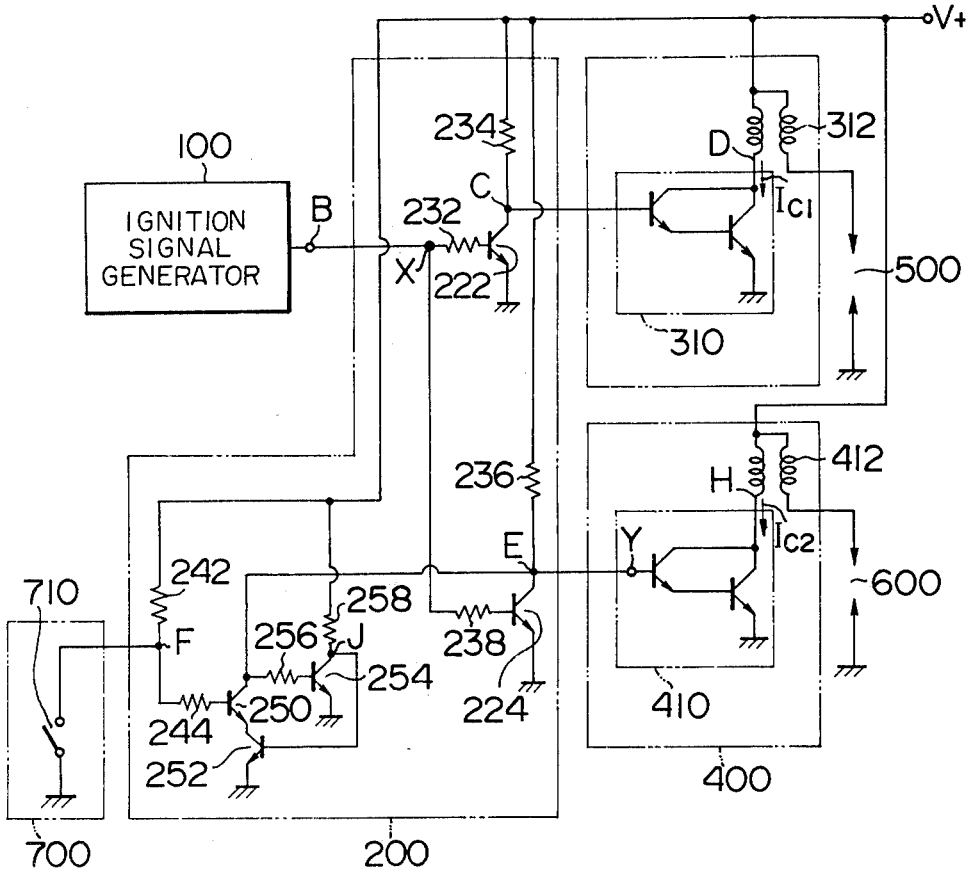
FIG. 6 shows a circuit diagram of another embodiment of the present invention.
Figure 7:
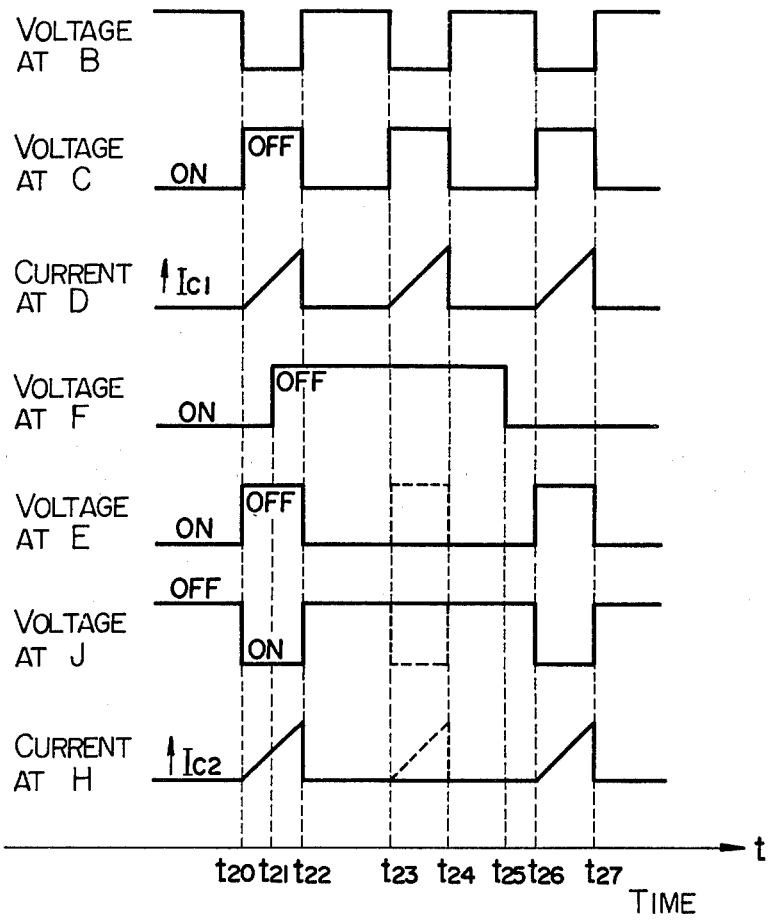
FIG. 7 shows waveforms at various points in FIG. 6.

FIG. 6 shows still another preferred embodiment of the present invention and FIG. 7 shows waveforms at various points in FIG. 6. Like numerals to those of FIG. 4 show like components. The present embodiment differs from the embodiment of FIG. 4 in that the control circuit comprising transistors 250, 252 and 254, and resistors 256 and 258 is added in lieu of the diode 248, the resistor 240 and the transistor 226 shown in FIG. 4. In FIG. 6, the signal applied to the base of the power transistor circuit 410 is applied to the collector of the transistor 250 and also to the base of the transistor 254 through the resistor 256. The emitter of the transistor 254 is grounded and the collector thereof is connected to the power supply $V_+$ through the resistor 258 and also to the base of the transistor 252. The emitter of the transistor 250 is connected to the collector of the transistor 252, the emitter of which is grounded.

Referring to FIG. 7, at the time $t_{20}$, the waveform of the ignition signal B generated by the ignition signal generating circuit 100 changes from its high level to its low level. As a result, the transistors 222 and 224 change from their on-state to their off-state respectively and the voltage waveforms at the collectors C and E thereof change from their low level to their high level. If the contact 710 is at its on-state, the transistor 250 is turned off, and hence the transistor 254 is turned on and the transistor 252 is turned off so that the actuation signals C and D are applied to the Darlington power transistor circuits 310 and 410, respectively, which energize the corresponding ignition coils 312 and 412 to start the ignition operation. The ignition signal continues until the time $t_{21}$. That is, the ignition operation period is from the time $t_{20}$ to the time $t_{22}$. If the ignition disabling signal for the spark plug 600 is generated at a time, e.g. the time $t_{21}$, during the ignition operation period by opening the contact 710, the transistor 250 is turned on. However, since the transistor 252 is at its off-state at this time $t_{21}$, the voltage at the point E is maintained at its high level and the on-state of the power transistor circuit 410 is maintained until the transistor 224 is turned on at the time $t_{22}$ to change the level at the point E to its low level. When the ignition signal terminates and the level at the point E is changed to its low level at the time $t_{22}$, the transistor 254 is turned off and the transistor 252 is turned on. Since the transistor 250 is also at its on-state, the level at the point E does not rise when the ignition signal B again changes to the low level at the time $t_{23}$ to turn off the transistor 238. Accordingly, the actuation signal is not applied to the power transistor circuit 410 and the primary current of the ignition coil 412 does not flow. The waveforms shown by broken lines in the voltage waveform E and the current waveform H in FIG. 7 show the waveforms which would appear during the ignition operation period $t_{23}$–$t_{24}$ if the contact 710 were closed.

When the contact 710 is closed at the time $t_{25}$, that is, when the disabling signal is released, the transistor 250 is turned off. Thus, if the ignition signal B is changed to its low level at the next time $t_{26}$, the transistor 224 is turned off and the level at the point E can change from its low level to its high level so that the sparking operation of the spark plug 600 is effected in the same manner as in the period $t_{20}$–$t_{22}$. If the release of the disabling signal does not occur at the time $t_{25}$ but occurs at some time between the times $t_{26}$ and $t_{27}$, the ignition operation is started from that time, but no problem occurs in this case as explained above in connection with FIGS. 4 and 5.

Figure 8:
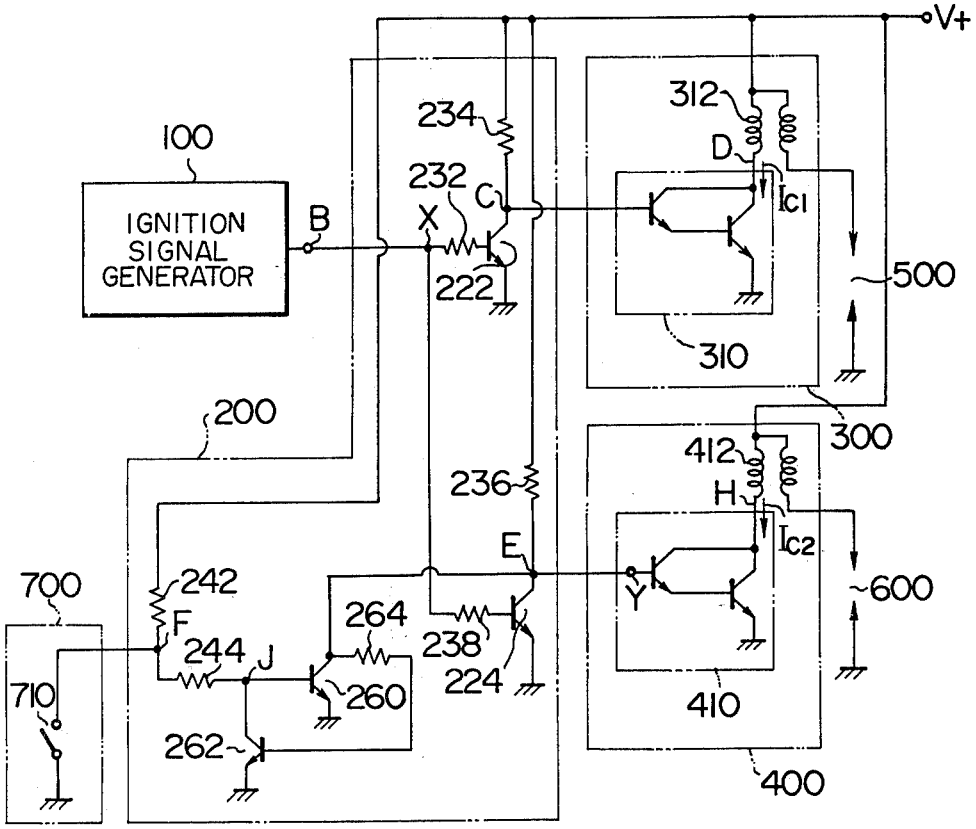
FIG. 8 shows a circuit diagram of a further embodiment of the present invention.

FIG. 8 shows a circut diagram of another preferred embodiment of the present invention. The present embodiment differs from the embodiment of FIG. 6 in that the control circuit in FIG. 6, which comprises the transistors 250, 252 and 254 and the resistors 244, 256 and 258 is replaced by a control circuit comprising transistors 260 and 262 and resistors 244 and 264. The other portions of the circuit are quite the same as those of FIG. 6. The transistors 260 and 262 constitute a flip-flop. The voltage and current waveforms at the points B, C, D, E, F are quite similar to those shown in FIG. 7 in connection with the embodiment of FIG. 6, and hence the operation of the embodiment of FIG. 8 will be explained with reference to FIG. 7. It is appreciated, however, that since the voltage level at the point J can not rise even if the transistor 262 is turned off so far as the contact 710 is closed, the waveform J of FIG. 7 merely shows the ON-OFF state of the transistor 262.

Assuming that the contact 710 is closed, when the ignition signal to the spark plugs 500 and 600 is generated at the time $t_{20}$, the ignition operation starts. The ignition operation is to be completed at the time $t_{22}$. Immediately before the time $t_{20}$, the level at the point F was low and hence the level of the base of the transistor 260 was also low so that the transistor 260 was at its off-state, and the level at the point E was low so that the transistor 262 was at its off-state. When the ignition signal B is generated at the time $T_{20}$, the level at the point E changes from its low level to its high level by the turn-off of the transistor 224 because the transistor 260 is at its off-state. In this case, the transistor 262 is turned on and the transistor 260 remains at its off-state because the base level thereof remains its low level. In this manner, the application of the actuation signal E to the power transistor circuit 410 is allowed.

Assume that the ignition disabling signal is generated by opening the contact 710 at a time, e.g. the time $t_{21}$ before the time $t_{22}$ at which the sparking operation of the spark plug 600 is to complete. Then, the potential level at the point F changes from its low level to its high level. However, the level at the point J does not rise because the transistor 262 is at its on-state. The transistor 260 is maintained at its off-state and the actuation signal E remains at its high level until the ignition completion time $t_{22}$.

The ignition operation is completed at the time $t_{22}$, in the same manner as that described above. When the ignition signal terminates at the time $t_{22}$ and the level at the point E changes from its high level to its low level, the transistor 262 is turned off and the level at the point J changes to the high level. Accordingly, the transistor 260 is turned on. Once the transistor 260 has been turned on, the transistor 262 is turned off and the on-off states of the transistors 260 and 262 do not change so long as the contact 710 is open. Thus, when the next ignition signal is generated at the time $t_{23}$, the level at the point E does not change to its high level and therefore the application of the actuation signal to the power transistor circuit 410 is inhibited. The waveforms shown by the broken lines in the voltage waveforms at the points E and J and the current waveform at the point H during the period $t_{23}$–$t_{24}$ show the waveforms which would appear if the contact 710 were closed. When the disabling command is released at the time $t_{25}$ to close the contact 710, the level at the point F changes to its low level but the transistors 260 and 262 remain at their on- and off-states respectively. Under this condition, if an ignition signal is next generated at the time $t_{26}$ by the ignition signal generating circuit 100, the transistor 260 is turned off and the transistor 262 is turned on so that the level at the point E changes to its high level to allow the application of the actuation signal to the power transistor circuit 410. The subsequent operation is the same as that described in connection with FIG. 6.

While NPN transistors are used in the illustrated embodiments, they may be all or partly replaced by PNP transistors.

As described before, the plurality of spark plugs for each cylinder may not be sparked simultaneously but the present invention can be applied to a system in which the spark plugs are sparked at different timings. In this case, a delay circuit for producing a phase difference between the actuation signals to the high voltage generating circuits 300 and 400 may be included in the actuation signal generating circuit 200 in FIG. 1, or it may be inserted in the actuation signal transmission path between the actuation signal generating circuit 200 and the high voltage generating circuit 400. It may further be included in the amplifier 210 in FIG. 2 or may be inserted in the $A_3$ signal transmission path between the amplifier 210 and the NOR gate 214, or alternatively in the $A_7$ signal transmission path between the NOR gate 214 and the high voltage generator 400. In the embodiments of FIGS. 4, 6 and 8, the delay circuit may be included in the signal path from the point X to the point Y. When the delay circuit is inserted, the phase relationships of the voltage and current waveforms at various points shown in FIGS. 3, 5 and 7 change partially but the operation and the effect of the present invention do not change, as will be readily understood by those skilled in the art.

As described hereinabove, according to the present invention, since the stop of the supply of the primary current to the selected one of the plurality of ignition coils is effected after the completion of the ignition operation by that selected ignition coil if the ignition operation has been started when the disabling command is issued, the failure of ignition is prevented, the reliability is enhanced and the durability is improved without additional cost increase.

We claim:

1. An ignition apparatus for a multicylinder reciprocating internal combustion engine comprising;

a plurality of spark plugs arranged in each cylinder;

a plurality of high voltage generating circuits each connected to corresponding one of said plurality of spark plugs;

an ignition signal generating circuit for generating an ignition signal indicative of ignition timing in accordance with the rotation of the engine;

means responsive to a predetermined condition for generating a disabling signal to disable the sparking operation of selected at least one of said plurality of spark plugs; and actuation signal generating means connected to said ignition signal generating circuit and said disabling signal generating means, for applying actuation signals in response to said ignition signal to said respective plurality of high voltage generating circuits to cause said high voltage generating circuits to generate high voltages thereby producing sparks at said corresponding spark plugs, said actuation signal generating means being operative in respect to said disabling signal in a manner so that said actuation signal generating means applies the actuations signals, in response to the ignition signal, to selected at least one of said high voltage generating circuits connected to said corresponding selected at least one of said plugs spark in the absence of said disabling signal and to said high voltage generating circuits other than said selected high voltage generating circuits irrespective of said disabling signal, said actuation signal generating means being operative in response to the generation of said disabling signal with respect to the application of the actuation signal to said selected high voltage generating circuit in a manner so that said actuation signal generating means allow said selected high voltage generating circuit to continue the igniting operation until the igniting operation is completed if said selected high voltage generating circuit has been actuated at the time when said disabling signal is generated and inhibits further application of the actuation signal to said selected high voltage generating circuit after the completion of said igniting operation while it inhibits the subsequent application of the actuation signal if said selected high voltage generating circuit is not being actuated at the time when said disabling signal is generated, said inhibition of the application of the actuation signal being continued so long as said disabling signal continues.

2. An ignition apparatus according to claim 1, wherein said actuation signal generating means includes an amplifier responsive to the ignition signal to produce a first binary actuation signal which assumes logical "1" level indicative of the presence of the actuation signal during the presence of said ignition signal and logical "0" level indicative of the absence of the actuation signal during the absence of said ignition signal, said first binary actuation signal being applied to each of said plurality of high voltage generating circuits other than said selected at least one as the actuation signal thereto, and a second binary actuation signal in opposite phase to said first binary actuation signal, a NOR gate having two input terminals to one of which said second binary actuation signal is applied and an output terminal connected to said selected high voltage generating circuit to apply the output thereof to said selected high voltage generating circuit as the actuation signal thereto, an AND gate having two input terminals and an output terminal connected to the other input terminal of said NOR gate, and an inverter connected between one of the two input terminals of said AND gate and the output terminal of said NOR gate, and wherein said disabling signal generating means is operative to apply the disabling signal to the other input terminal of said AND gate, said disabling signal including a binary disabling signal which assumes a logical "1" level indicative of the presence of said disabling signal when the sparking operation of said selected at least one spark plug is to be stopped and a logical "0" level indicative of the absence of said disabling signal when the sparking operation is not to be stopped.

3. An ignition apparatus according to claim 1, wherein said actuation signal generating means includes a first amplifier which is responsive to said ignition signal to produce the actuation signal to be applied to each of said plurality of high voltage generating circuits other than said selected at least one, a second amplifier which is responsive to said ignition signal to produce the actuation signal to be applied to said selected at least one high voltage generating circuit, and a control circuit which is responsive to said disabling signal to disable the generation of said actuation signal by said second amplifier.

4. An ignition apparatus according to claim 3, wherein said first and second amplifiers respectively produce, as the actuation signal, a first and a second binary actuation signal each assuming a logical "1" level indicative of the presence of said actuation signal during the period for actuating the associated high voltage generating circuits and a logical "0" level indicative of the absence of said actuation signal during the other period, and wherein said disabling signal generating means produces, as the disabling signal, a binary disabling signal assuming a logical "1" level indicative of the presence of said disabling signal during the period for commanding to disable the sparking operation of said selected at least one spark plug and a logical "0" level indicative of the absence of said disabling signal.

5. An ignition apparatus according to claim 4, wherein said ignition signal includes a binary ignition signal which assumes a logical "0" level indicative of the presence of said ignition signal during the period for actuating the associated high voltage generating circuits and assumes a logical "1" level indicative of the absence of said ignition signal during the other period, and wherein said first and second amplifiers include a first and a second transistor circuit, respectively, each of said first and second transistor circuits having a base, a collector and an emitter, said first and second transistor circuits being responsive to said binary ignition signal to be turned off by being applied the logical "0" level of said binary ignition signal to the respective bases thereof and turned on by being applied the logical "1" level of said binary ignition signal to the respective bases thereof, thereby producing said first and second binary actuation signals at the respective emitter-collector circuits of said first and second transistors.

6. An ignition apparatus according to claim 5, wherein said control circuit includes a diode for supplying said logical "1" level of said binary disabling signal to the base of said second transistor circuit, and a third transistor circuit having a base thereof connected to the collector of said second transistor circuit and a collector-emitter circuit thereof connected to said disabling signal generating means, said third transistor circuit being turned on when said collector-emitter circuit of said second transistor circuit assumes a logical "1" level to inhibit the application of the logical "1" level of said binary disabling signal to the base of said second transistor circuit through said diode.

7. An ignition circuit according to claim 5, wherein said control circuit includes third, fourth and fifth transistor circuits each having a base, a collector and an emitter, the respective emitter-collector circuits of said third and fourth transistor circuits being connected in series with each other and connected to the collector-emitter circuit of said second transistor circuit to inhibit said second binary actuation signal generated by said second transistor circuit from assuming its logical "1" level when said third and fourth transistor circuits are both in on-state, the base of said fifth transistor circuit being connected to the collector-emitter of said second transistor circuit, said fifth transistor circuit being respectively turned on and off, when the second binary actuation signal assumes the logical "1" level and the logical "0" level, to produce a logical "0" level signal and a logical "1" level signal respectively at the collector-emitter circuit thereof, the base of said third transistor circuit being connected to said disabling signal generating means, the base of said fourth transistor circuit being connected to the collector-emitter circuit of said fifth transistor circuit.

8. An ignition apparatus according to claim 5, wherein said control circuit includes a third transistor circuit having a base thereof connected to said disabling signal generating means and a collector-emitter circuit thereof connected to the collector-emitter circuit of said second transistor circuit, said third transistor circuit being operative, when it is turned on, to inhibit said second binary actuation signal from assuming its logical "1" level, and a fourth transistor circuit having a base thereof connected to said collector-emitter circuit of said second transistor circuit and a collector-emitter circuit thereof connected to the base of said third transistor circuit, said fourth transistor circuit being operative, when it is turned on, to inhibit the logical "1" level of said binary disabling signal from being applied to the base of said third transistor circuit.

9. An ignition apparatus according to any one of claims 6, 7 or 8, wherein each of said high voltage generating circuits includes an ignition coil having a secondary connected to the corresponding one of said spark plugs, and a power transistor circuit having a base thereof connected to the collector-emitter circuit of its respective transistor circuit and a collector-emitter circuit thereof connected in series with a primary of said ignition coil, said power transistor circuit being operative when it is turned on to allow a current to flow in said primary of said ignition coil.

10. An ignition apparatus according to any one of claims 6, 7 or 8, wherein said ignition signal generating circuit includes a pickup coil for generating an A.C. signal in accordance with the rotation of said engine, and a waveform shaper responsive to said A.C. signal to produce the ignition signal which assumes binary valves of logical "1" and logical "0".

11. An ignition apparatus according to any one of claims 6, 7 or 8, wherein said disabling signal generating means includes a contact means which produces a logical "1" level signal at an output terminal thereof when it is open and a logical "0" level signal when it is closed.

* * * * *